US007874138B2

(12) United States Patent
Rubio et al.

(10) Patent No.: US 7,874,138 B2
(45) Date of Patent: Jan. 25, 2011

(54) SEGMENTED ANNULAR COMBUSTOR

(75) Inventors: Mark B. Rubio, Winter Park, FL (US); David M. Ritland, Winter Park, FL (US)

(73) Assignee: Siemens Energy, Inc., Orlando, FL (US)

( * ) Notice: Subject to any disclaimer, the term of this patent is extended or adjusted under 35 U.S.C. 154(b) by 118 days.

(21) Appl. No.: 12/208,513

(22) Filed: Sep. 11, 2008

(65) Prior Publication Data

US 2010/0058763 A1 Mar. 11, 2010

(51) Int. Cl.
*F02C 3/00* (2006.01)

(52) U.S. Cl. ..... 60/39.37; 60/752

(58) Field of Classification Search ..... 60/751–760, 60/804, 806, 39.37
See application file for complete search history.

(56) References Cited

U.S. PATENT DOCUMENTS

| | | | | | |
|---|---|---|---|---|---|
| 2,595,999 | A | * | 5/1952 | Boyd et al. | 60/752 |
| 2,625,792 | A | * | 1/1953 | McCarthy et al. | 60/757 |
| 3,657,882 | A | * | 4/1972 | Hugoson | 60/798 |
| 3,657,883 | A | * | 4/1972 | De Corso | 60/39.37 |
| 4,158,949 | A | | 6/1979 | Reider | |
| 4,297,843 | A | * | 11/1981 | Sato et al. | 60/796 |
| 4,373,327 | A | * | 2/1983 | Adkins | 60/39.37 |
| 4,614,082 | A | | 9/1986 | Sterman et al. | |
| 4,720,970 | A | | 1/1988 | Hudson et al. | |
| 4,843,825 | A | * | 7/1989 | Clark | 60/756 |
| 5,239,818 | A | * | 8/1993 | Stickles et al. | 60/804 |
| 5,297,385 | A | | 3/1994 | Dubell et al. | |
| 5,924,288 | A | | 7/1999 | Fortuna et al. | |
| 6,082,111 | A | | 7/2000 | Stokes | |
| 6,098,397 | A | * | 8/2000 | Glezer et al. | 60/772 |
| 6,276,142 | B1 | | 8/2001 | Putz | |
| 6,374,593 | B1 | | 4/2002 | Ziegner | |
| 7,334,960 | B2 | | 2/2008 | Glessner et al. | |

* cited by examiner

*Primary Examiner*—William H Rodriguez
*Assistant Examiner*—Phutthiwat Wongwian

(57) ABSTRACT

A combustor for use in a turbine engine including a compressor section, a combustion section downstream from the compressor section, and a turbine section downstream from the combustion section. An inner annulus wall extends from a burner end of the combustor to an outlet end of the combustor. An outer annulus wall is disposed outwardly from the inner annulus wall and extends from the burner end of the combustor to the outlet end of the combustor. A passageway is formed between the inner annulus wall and the outer annulus wall and extends from a combustion zone to the outlet end of the combustor. A plurality of symmetrically distributed section walls extends between the inner annulus wall and the outer annulus wall from the burner end of the combustor toward the outlet end of the combustor. The section walls divide the combustion zone into a plurality of segments.

20 Claims, 7 Drawing Sheets

SEGMENTED ANNULAR COMBUSTOR

FIELD OF THE INVENTION

The present invention relates to an annular combustor for use in a turbine engine, and more particularly, to an annular combustor including a plurality of section walls that operate to reduce combustion oscillations.

BACKGROUND OF THE INVENTION

In gas turbine engines, compressed air discharged from a compressor section and fuel introduced from a source of fuel are mixed together and burned in a combustion section. The mixture is directed through a turbine section, where the mixture expands to provide rotation of a turbine rotor. The turbine rotor may be linked to an electric generator, wherein the rotation of the turbine rotor can be used to produce electricity in the generator.

Gas turbine engines using annular combustion systems typically include a plurality of individual burners or fuel nozzles disposed in a ring about an axial centerline for providing a mixture of fuel and air to an annular combustion chamber disposed upstream of the turbine section of the engine. The combustion process of the burners will interact in the combustion chamber since all burners discharge the combustible mixture to the single annulus. Consequently, combustion processes in one burner may affect the combustion processes in the other burners. Other gas turbines use "can-annular" combustors, wherein individual burner cans feed hot combustion gas into respective individual portions of the arc of the turbine inlet vanes. Each "can" includes a plurality of main burners disposed in a ring around a central pilot burner, as illustrated in U.S. Pat. No. 6,082,111.

During operation of the burners, the formation of combustion oscillations can occur, which are also known as combustion chamber humming. The combustion oscillations may be caused by an interaction between the fuel and air mixture. Combustion oscillations can cause an increased production of noise and may also increase mechanical and thermal loads on walls surrounding the combustion chamber and on other components in and around the combustion section. In modern engines, temperatures in the combustion section have increased to increase the output power of the engine, thus exacerbating the problems associated with combustion oscillations. Because "can-annular" systems have several independent combustion zones, thermoacoustic problems, including combustion oscillations, can be tuned out on an individual basis and can be predicted by testing only one "can".

However, it would be desirable to design a non-can-annular system that could be tuned on an individual basis such that thermoacoustic problems could be predicted by testing only a portion of the system.

SUMMARY OF THE INVENTION

In accordance with a first aspect of the present invention, a combustor is provided for use in a turbine engine comprising a compressor section, a combustion section downstream from the compressor section, and a turbine section downstream from the combustion section. The combustor comprises an inner annulus wall extending from a burner end of the combustor to an outlet end of the combustor adjacent the turbine section of the engine and an outer annulus wall disposed outwardly from the inner annulus wall and extending from the burner end of the combustor to the outlet end of the combustor adjacent the turbine section of the engine. A combustion zone is formed between the inner annulus wall and the outer annulus wall. The combustion zone defines an area adjacent to the burner end of the combustor where air transported from the compressor section of the engine is mixed with a fuel and ignited. A passageway is formed between the inner annulus wall and the outer annulus wall extending from the combustion zone to the outlet end of the combustor for conveying an ignited air and fuel mixture from the combustion zone to the outlet end of the combustor. A plurality of burners is associated with the burner end of the combustor for distributing the fuel to the combustion zone. A plurality of symmetrically distributed section walls extend between the inner annulus wall and the outer annulus wall from the burner end of the combustor toward the outlet end of the combustor. The section walls divide the combustion zone into a plurality of segments.

In accordance with a second aspect of the present invention, an annular combustor is provided for use in a turbine engine comprising a compressor section, a combustion section downstream from the compressor section, and a turbine section downstream from the combustion section. The annular combustor comprises a generally circumferential inner annulus wall extending from a burner end of the annular combustor to an outlet end of the annular combustor adjacent the turbine section of the engine and a generally circumferential outer annulus wall disposed outwardly from the inner annulus wall and extending from the burner end of the annular combustor to the outlet end of the annular combustor adjacent the turbine section of the engine. A combustion zone is formed between the inner annulus wall and the outer annulus wall. The combustion zone defines an area adjacent to the burner end of the annular combustor where air transported from the compressor section of the engine is mixed with a fuel and ignited. A passageway is formed between the inner annulus wall and the outer annulus wall extending from the combustion zone to the outlet end of the combustor for conveying an ignited air and fuel mixture from the combustion zone to the outlet end of the combustor. A plurality of burners is associated with the burner end of the annular combustor for distributing the fuel to the combustion zone. A plurality of symmetrically distributed section walls extends between the inner annulus wall and the outer annulus wall from the burner end of the annular combustor to the outlet end of the annular combustor. The section walls divide the combustion zone into a plurality of segments, each segment containing at least one of the burners.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
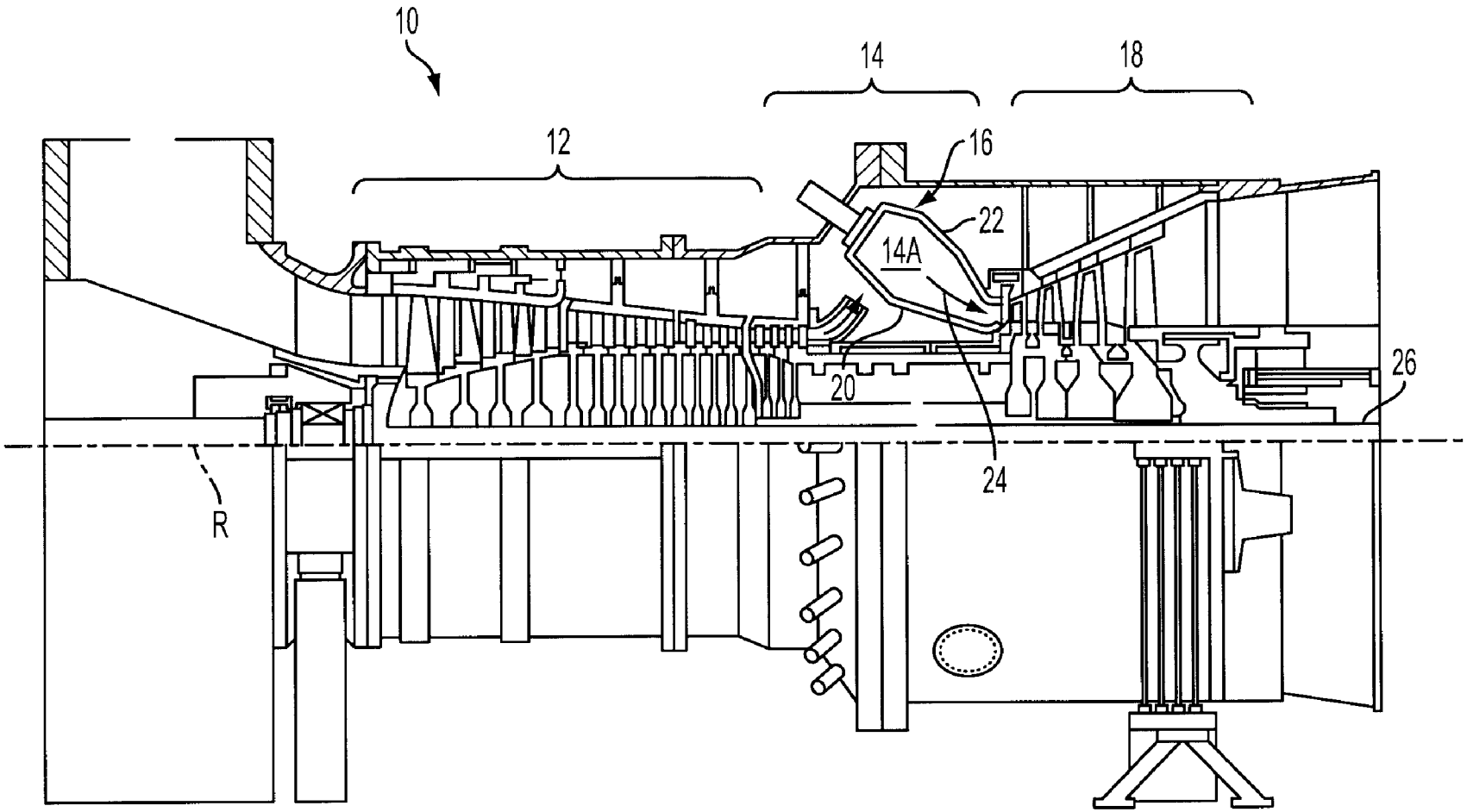
FIG. 1 is a sectional view of a gas turbine engine including an annular combustor according to an embodiment of the invention.

Referring to FIG. 1, a gas turbine engine 10 is shown. The engine 10 includes a compressor section 12, a combustion section 14 including an annular combustor 16, and a turbine section 18. The compressor section 12 inducts and pressurizes inlet air which is directed to the combustor 16 in the combustion section 14. Upon entering the combustor 16, the compressed air from the compressor section 12 is mixed with a fuel and ignited in a main combustion zone 14A defined between an inner annulus wall 20 and an outer annulus wall 22 disposed radially outward from the inner annulus wall 20 of the combustor 16 to produce a high temperature and high velocity combustion gas flowing in a turbulent manner. The combustion gas then flows along a passageway 24 to the turbine section 18 where the combustion gas is expanded to provide rotation of a turbine rotor 26 that rotates about an axis of rotation R.

Figure 2:
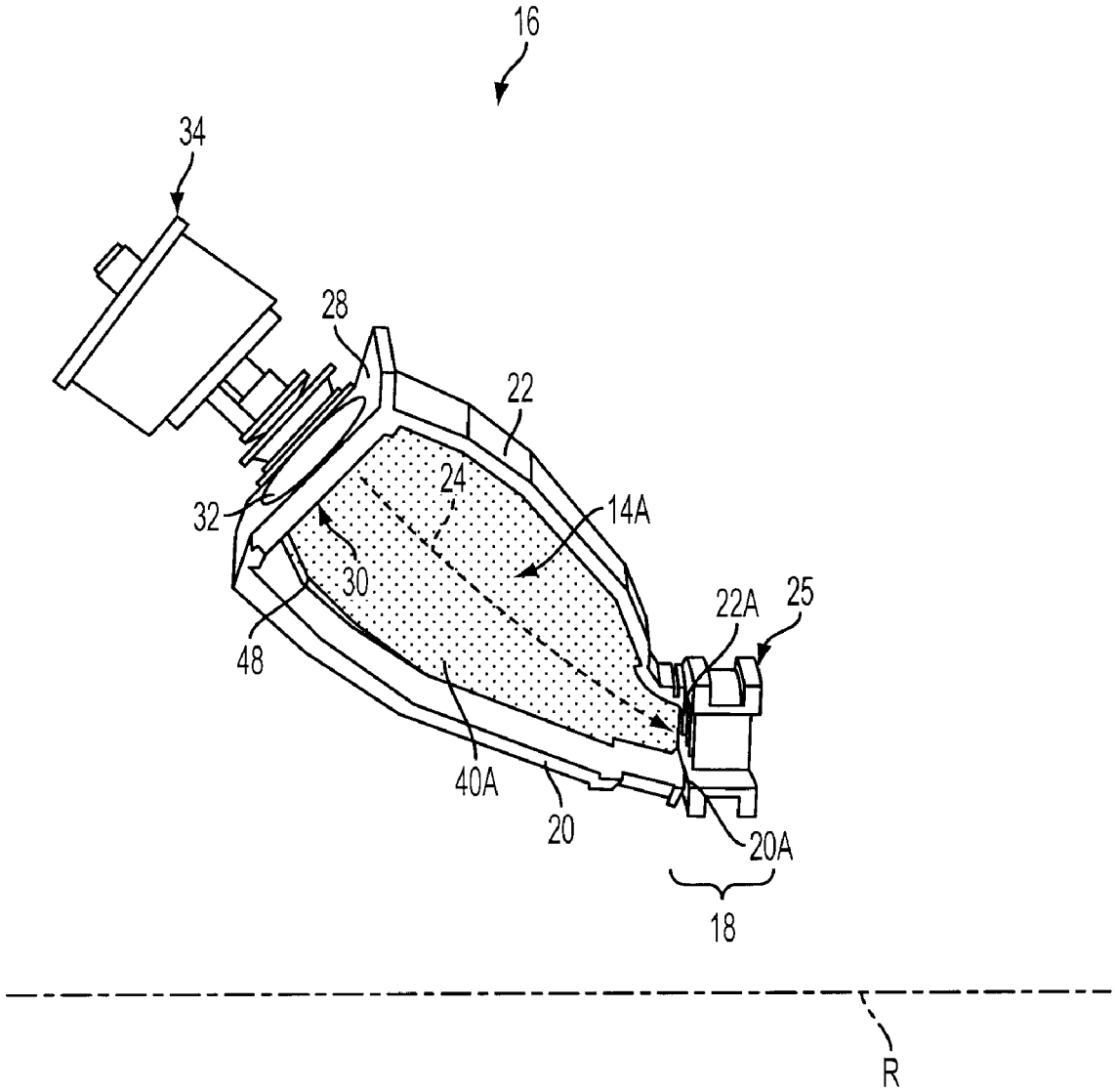
FIG. 2 is a side cross sectional view of a portion of the annular combustor illustrated in FIG. 1.
Figure 3:
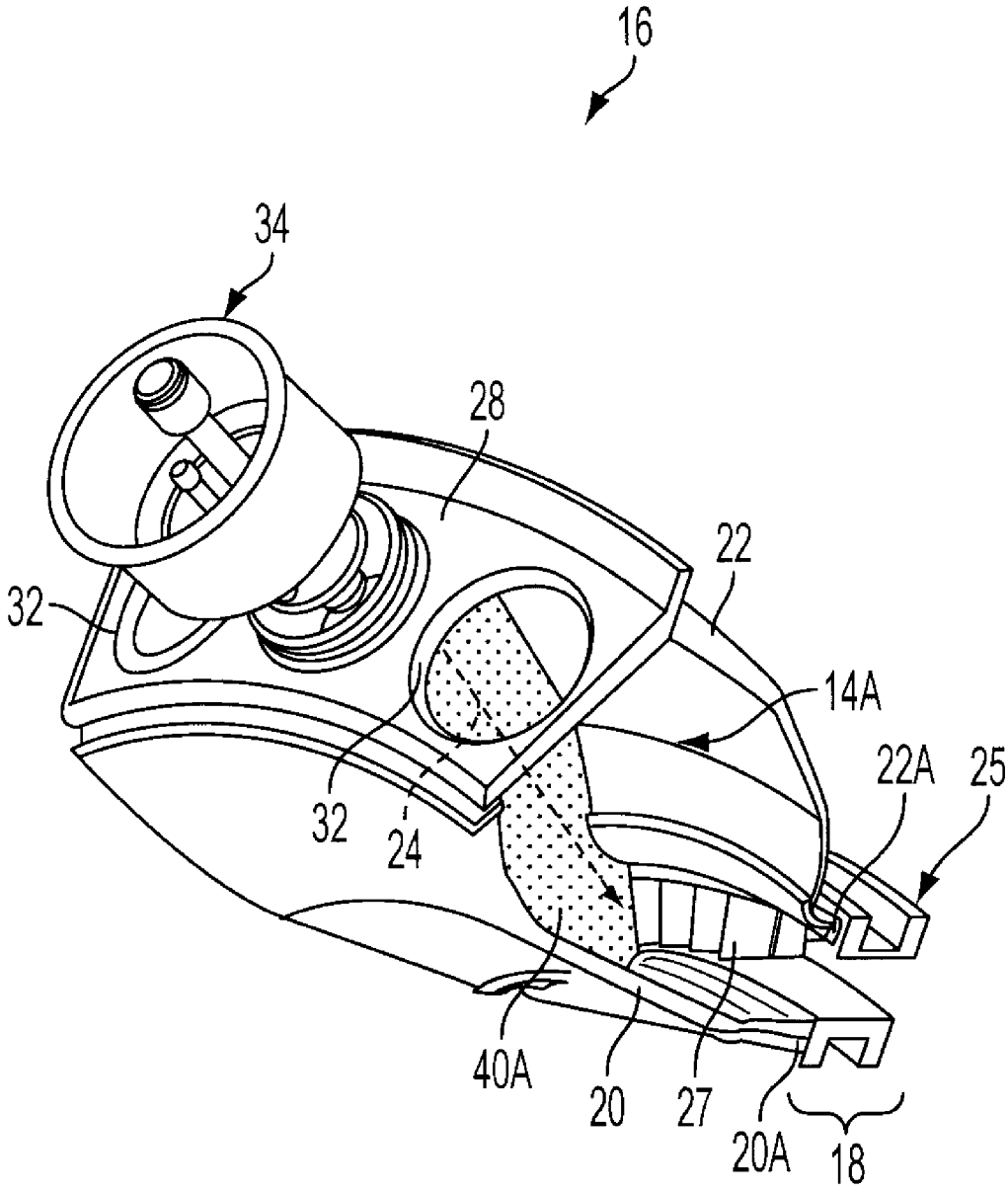
FIG. 3 is a perspective, partially cut-away view of a portion of the annular combustor.

Referring now to FIGS. 2 and 3, a cross sectional view of an upper portion of the combustor 16 is shown. It is noted that the configuration of the upper and lower portions of the annular combustor 16 can further be seen in FIG. 4, however, only the upper portion of the combustor 16 is shown in FIGS. 2 and 3 for clarity. It is also noted that the lower portion of the combustor 16 is a substantial mirror image of the upper portion of the combustor 16 shown in FIGS. 2 and 3. The inner annulus wall 20 and the outer annulus wall 22 cooperate to define the main combustion zone 14A therein, as discussed above. The inner and outer annulus walls 20, 22 may be formed from any suitable material capable of withstanding the high temperature environment of the combustion section 14 of the engine 10, such as, for example, alloy steel.

The inner and outer annulus walls 20, 22 extend radially inwardly in the embodiment shown and merge with a component 25 of the turbine section 18 of the engine 10 at respective outlet ends 20A, 22A thereof. The inner and outer annulus walls 20, 22 cooperate to form the passageway 24 from a burner end 30 of the combustor 16 to the outlet ends 20A, 22A thereof for the combustion gas flowing to the turbine section 18 of the engine 10. As shown in FIG. 2, the outlet ends 20A, 22A of the inner and outer annulus walls 20, 22 are located at an entrance to the turbine section 18 of the engine and are slightly upstream from a first row of vanes 27 (see FIG. 3) of the turbine section 18. It is noted that, for clarity, some of the vanes 27 have been removed from the entrance to the turbine section 18 shown in FIG. 3.

In the embodiment shown, the outer annulus wall 22 includes a forward wall portion 28 at the burner end 30 of the combustor 16. It is understood that the forward wall portion 28 could be formed as part of the inner annulus wall 20, or could be a separate piece from the inner and outer annulus walls 20, 22. As seen in FIGS. 2 and 3, the forward wall portion 28 includes a plurality of apertures 32 formed therein for receiving a plurality of burners 34 or fuel nozzles associated with the burner end 30. It should be noted that although one burner 34 is shown in FIGS. 2 and 3, in a typical configuration of the combustor 16, each of the apertures 32 would include a respective burner 34. The burners 34 supply at least a portion of the fuel that is mixed with the air from the compressor section 12 in the main combustion zone 14A, and also provide for igniting the air and fuel mixture in the main combustion zone 14A.

Figure 4:
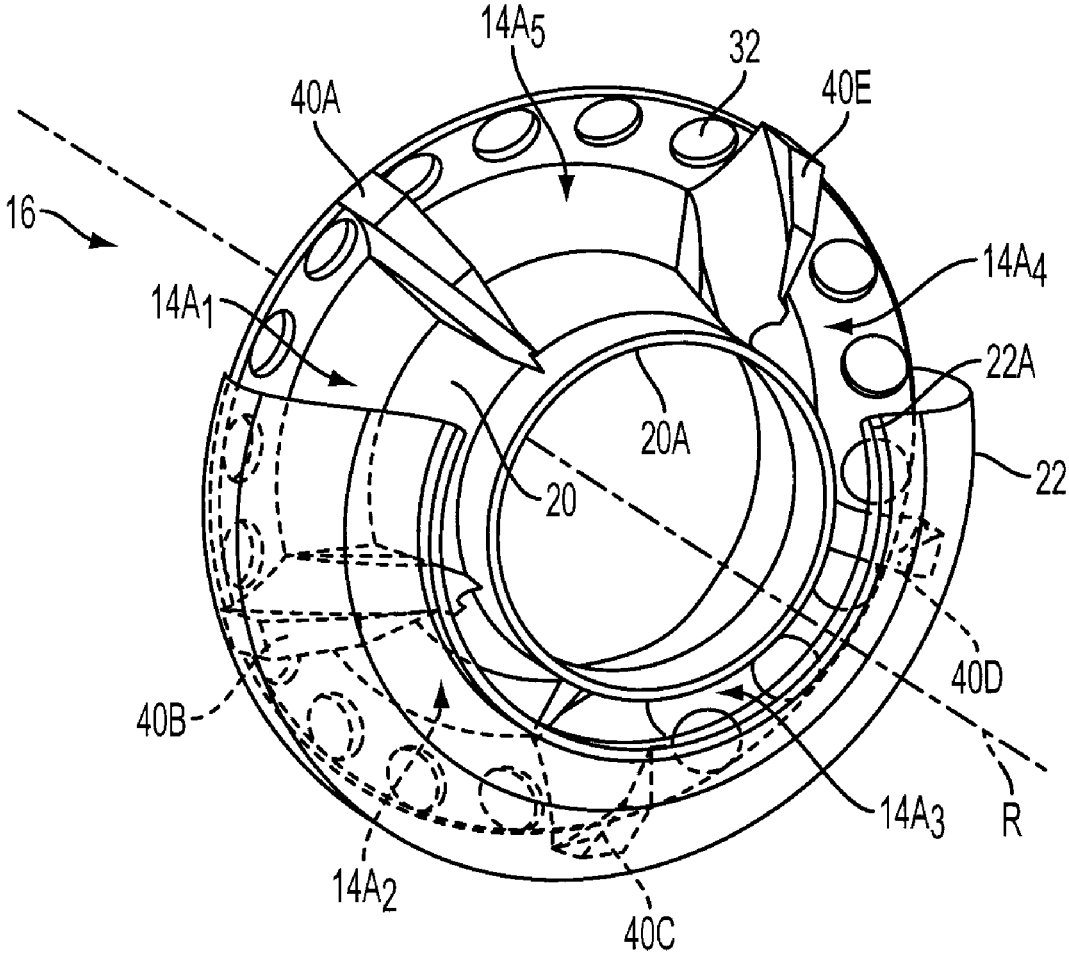
FIG. 4 is a front perspective view of the annular combustor with a portion of an outer annulus wall thereof removed.

As shown in FIGS. 2-4, section walls 40A, 40B, 40C, 40D, 40E are symmetrically distributed around the circumference of the combustor 16 and, in the illustrated embodiment, divide the main combustion zone 14A into a plurality of substantially equal segments. As seen in FIG. 4, five section walls 40A, 40B, 40C, 40D, 40E divide the main combustion zone 14A into five substantially equal chambers or segments $14A_1$, $14A_2$, $14A_3$, $14A_4$, $14A_5$, each segment $14A_1$-$14A_5$ including four burners 34. It is understood that other configurations exist and that the number of section walls 40A-40E for a given engine 10 may vary depending upon the particular use and arrangement of the engine 10, the number of burners 34 employed therein, and/or the frequency or frequencies that are desirably avoided, for example. The shapes of the section walls 40A-40E substantially correspond to the shape defined by corresponding surfaces of the inner and outer annulus walls 20, 22, as most clearly shown in FIG. 2, such that the air and fuel mixture and combustion gas located in each segment $14A_1$-$14A_5$ is substantially retained therein and does not leak into an adjacent segment $14A_1$-$14A_5$. In the embodiment shown in FIGS. 2-4, the section walls 40A-40E extend from the burner end 30 of the combustor 16 all the way to the component 25 of the turbine section 18 of the engine 10 adjacent to an upstream end of the vanes 27, although the section walls 40A-40E may extend from the burner end 30 of the combustor 16 toward the outlet ends 20A, 22A of the inner and outer annulus walls 20, 22 to any suitable location.

Figure 5:
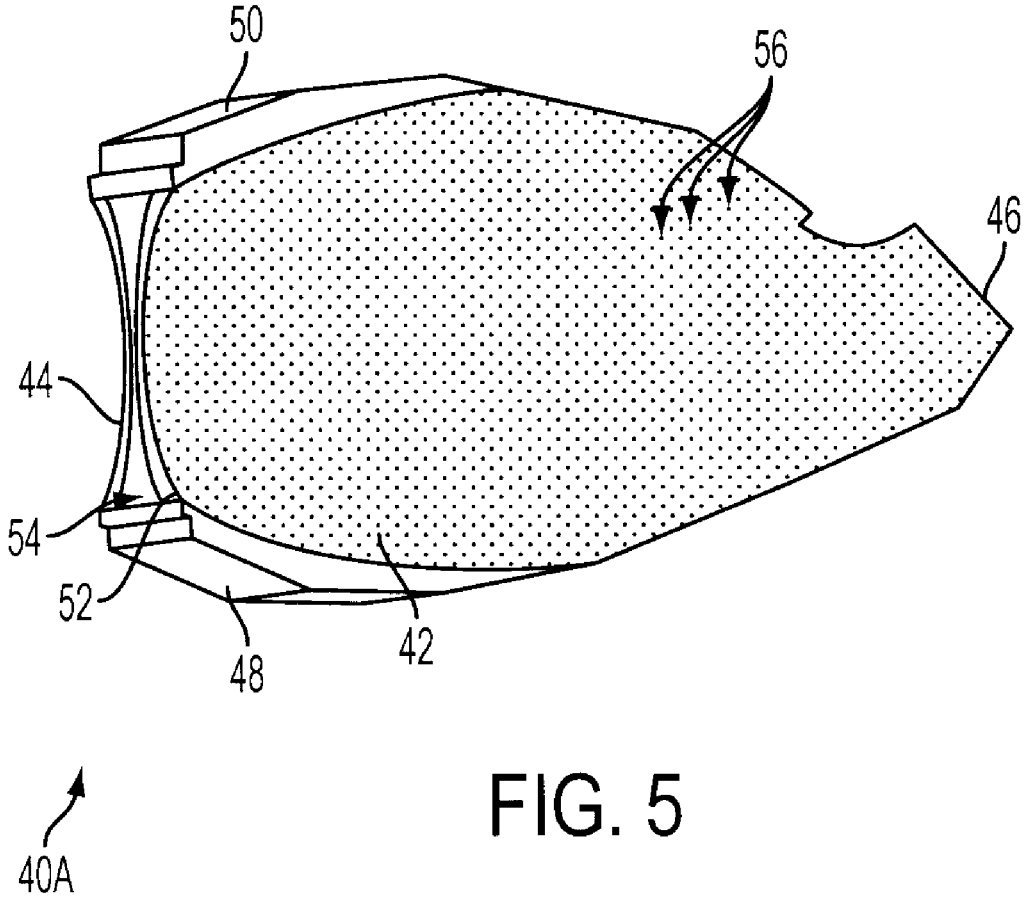
FIG. 5 is a rear perspective view of a segmentation wall employed in the annular combustor.
Figure 6:
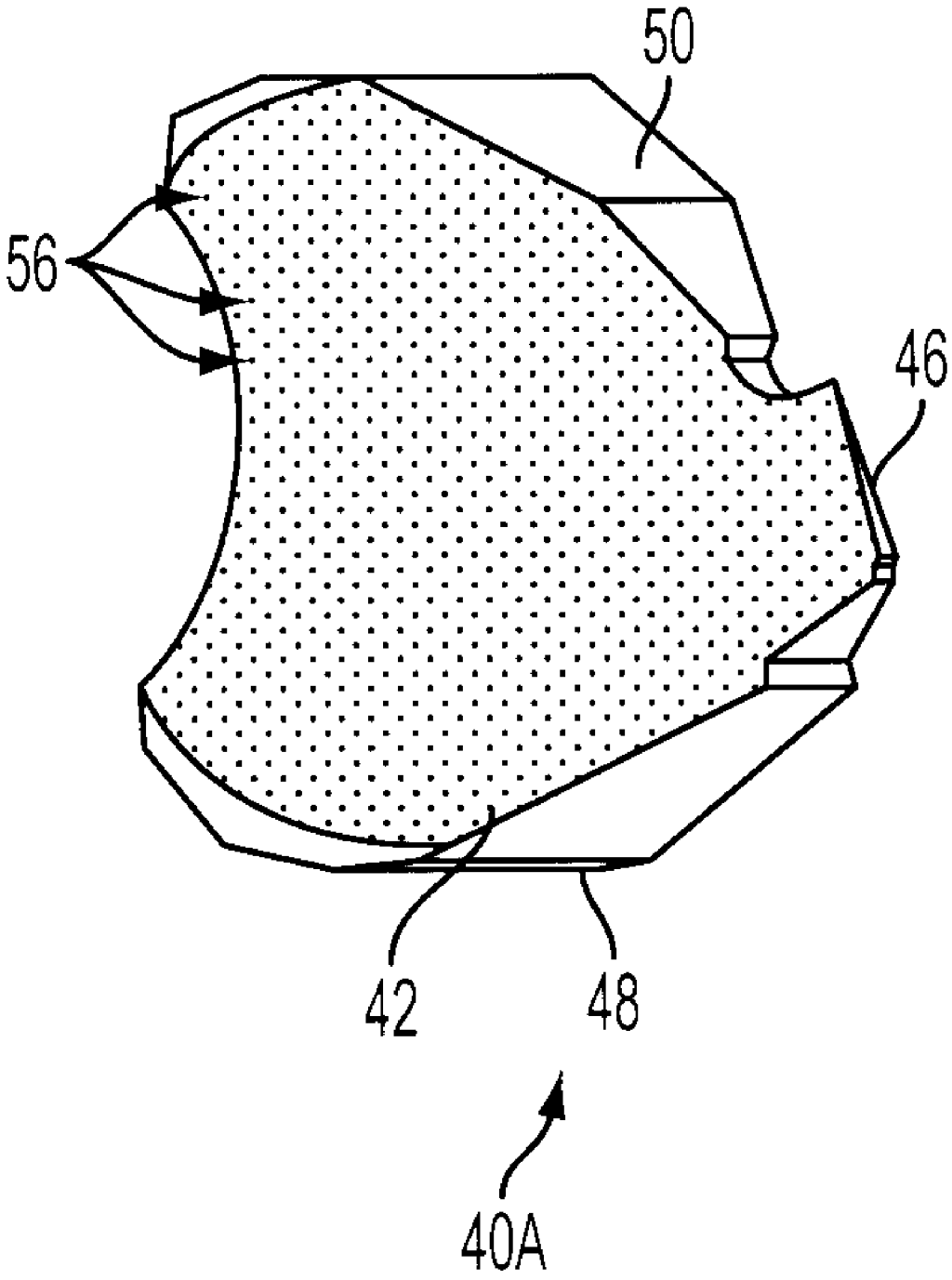
FIG. 6 is a front perspective view of the segmentation wall illustrated in FIG. 5.
Figure 7:
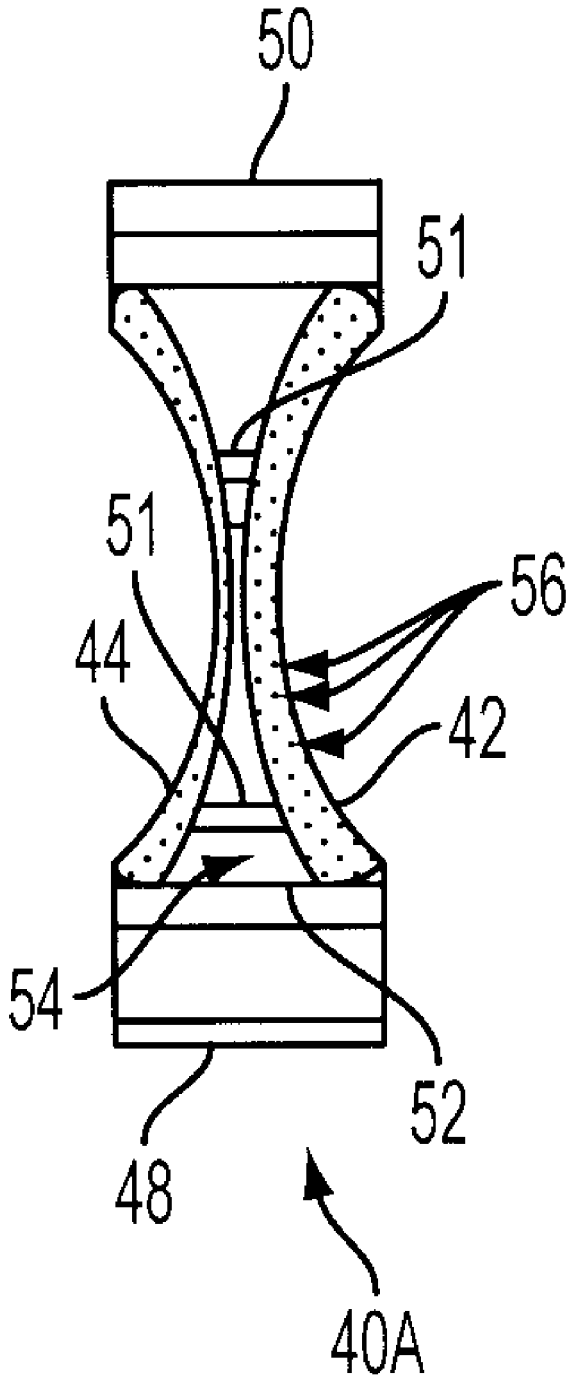
FIG. 7 is a rear view of the segmentation wall illustrated in FIG. 5.

Referring to FIGS. 5-7, the section walls 40A-40E will now be described with reference to the section wall 40A, it being understood that each of the section walls 40B-40E is substantially similar to the section wall 40A as described in detail herein. The section wall 40A can be formed from a material capable of withstanding the high temperature environment of the combustion section 14 of the engine 10, such as, for example, a ceramic material or a metal coated with a thermal barrier coating. Further, the section wall 40A may be formed of other structural components, such as a frame (not shown) that supports ceramic tiles (not shown) attached to the frame, for example. For example, the frame may form a skeleton for supporting the ceramic tiles that are disposed on the frame to form the section wall 40A. The section wall 40A in the embodiment shown includes first and second side walls 42, 44 that extend generally axially and slightly toward one another such as to converge and form a tapered aft end 46, as shown in FIGS. 5 and 6. Bottom and top walls 48, 50 of the section wall 40A extend along and are rigidly affixed to the inner and outer annulus walls 20, 22 to form a substantially fluid tight seal with the inner and outer annulus walls 20, 22, respectively, such that the air and fuel mixture and combustion gas does not leak between adjacent segments $14A_1$-$14A_5$ as discussed above. In addition, the first and second walls 42, 44 curve concavely toward each other in the radial direction, i.e., from the bottom wall 48 to the top wall 50. Optionally, one or more spanning members 51 may be disposed between the side walls 42, 44 and/or between the bottom and top walls 48, 50 so as to create an I-beam structure internal to the section wall 40A to increase the rigidity of the section wall 40A and accordingly the rigidity of the combustor 16.

As shown in FIGS. 5 and 7, the side, bottom, and top walls 42, 44, 48, 50 cooperate to form an open forward end 52 of the section wall 40A that initiates a hollow portion 54 of the section wall 40A, although it is understood that the section wall 40A could be formed from a solid piece of material, i.e., with no hollow portion hollow 54 formed therein. It should also be understood that the hollow portion 54 could be formed elsewhere in the section wall 40A other than as shown in the drawings, i.e., the forward end 52 of the section wall 40A could be closed, wherein the hollow portion 54 may initiate downstream from the forward end 52 of the section wall 40A. Each of the side walls 42, 44 in the embodiment shown in FIGS. 5-7 includes a plurality of apertures 56 formed therein for permitting small amounts of air or the air and fuel mixture and the combustion gas to flow into and out of the hollow portion 54 of the section wall 40A. The hollow portion 54 and the apertures 56 may cooperate to act as a resonator within the combustion section 14 of the engine 10 as will be described in greater detail below.

Optionally, the section wall 40A may be cooled, such as with bleed air provided for cooling components within the compressor section 12 of the engine. The bleed air may be introduced into the section wall 40A through the open forward end 52 or through an opening (not shown) in one or more of the bottom and top walls 48, 50, for example.

During operation of the engine 10, the section walls 40-40E effectively increase the rigidity of the combustor 16 by creating an I-beam structure with the inner and outer annulus walls 20, 22, which effects a change in the vibration of the combustor 16. Accordingly, the vibration of the combustor 16 can be controlled to be considerably distant from undesired frequencies, such as, for example, the natural frequency within the combustor 16, by selecting an appropriate number of section walls 40A-40E and an appropriate rigidity of the section walls 40A-40E.

Further, since the section walls 40A-40E isolate the air and fuel mixture and the combustion gas in each corresponding segment 14$A_1$-14$A_5$ of the main combustion zone 14A, the segments 14$A_1$-14$A_5$ can be tuned on an individual basis such that thermoacoustic problems with the combustor 16 can be identified and corrected. For example, the tuning of the segments 14$A_1$-14$A_5$ can be modified by varying the number of section walls 40A-40E, changing the rigidity of the sectional walls 40A-40E, i.e., by including additional or fewer spanning members 51 in the section walls 40A-40E, and/or by changing the configuration of the hollow portion 54 and or the size and/or number of apertures 56 formed in the section walls 40A-40E. It is understood that each of the section walls 40A-40E may have substantially similar characteristics such that the section walls 40A-40E can be tuned to substantially similar frequencies or the section walls 40A-40E may have different characteristics from one another such that the section walls 40A-40E can be tuned to different frequencies. The section walls 40A-40E reduce vibrations and humming in the combustor 16 by increasing the thermoacoustic stability margin at substantially all temperatures within the combustor 16. Accordingly, the engine 10 can be run at higher firing temperatures and/or loads compared to firing temperatures and loads of prior art engines employing annular combustors without the section walls 40A-40E and corresponding segments 14$A_1$-14$A_5$ as provided with the current invention. Hence, a power output of the engine 10 may be increased as compared to prior art engines.

Additionally, as the air or air and fuel mixture and the combustion gas flows into and out of the hollow portion 54 of the section walls 40A-40E through the apertures 56 in the side walls 42, 44, the hollow portion 54 acts as a resonator to further reduce vibrations within the combustion section 14 of the engine 10 and therefore reduces damage to the components of the engine 10 in and around the combustion section 14 that could be caused by high vibrations.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustor for use in a turbine engine comprising a compressor section, a combustion section downstream from the compressor section, a turbine section downstream from the combustion section, and defining an axis of rotation, the combustor comprising:

an inner annulus wall extending from a burner end of the combustor to an outlet end of the combustor adjacent the turbine section of the engine;

an outer annulus wall disposed outwardly from said inner annulus wall and extending from said burner end of the combustor to said outlet end of the combustor adjacent the turbine section of the engine;

a combustion zone defined by said inner annulus wall and said outer annulus wall and extending continuously from said inner annulus wall to said outer annulus wall, said combustion zone defining an area adjacent to said burner end of the combustor where air transported from the compressor section of the engine is mixed with a fuel and ignited;

a passageway formed between said inner annulus wall and said outer annulus wall extending from said combustion zone to said outlet end of the combustor for conveying an ignited air and fuel mixture from said combustion zone to said outlet end of the combustor;

a plurality of burners associated with said burner end of the combustor for distributing the fuel to said combustion zone; and a plurality of section walls symmetrically distributed about the axis of rotation of the turbine engine, the section walls extending radially from said inner annulus wall to said outer annulus wall and extending from said burner end of the combustor toward to said outlet end of the combustor, said section walls dividing said combustion zone into a plurality of segments.

2. The combustor according to claim 1, wherein said section walls extend continuously in contact with said inner and outer annulus walls from said burner end of said combustor to within close proximity of said outlet end of the combustor.

3. The combustor according to claim 1, wherein said section walls extend continuously in contact with said inner and outer annulus walls from said burner end of said combustor to the turbine section of the engine.

4. The combustor according to claim 1, wherein at least one of said section walls comprises a tapered end portion.

5. The combustor according to claim 1, wherein at least one of said section walls comprises at least one hollow portion that acts as a resonator for reducing vibrations of the combustor.

6. The combustor according to claim 5, wherein at least one of said section walls includes at least one aperture formed in an outer surface thereof in communication with said hollow portion, said at least one aperture permitting a flow of a fluid therethough between a location outside of said section wall and said hollow portion.

7. The combustor according to claim 5, wherein first and second side walls of at least one of said section walls include a plurality of apertures formed in outer surfaces thereof in communication with said hollow portion, said apertures permitting a flow of a fluid therethough between a location outside of said section wall and said hollow portion.

8. The combustor according to claim 1, wherein said segments each include a plurality of said burners.

9. The combustor according to claim 1, wherein said section walls each create an I-beam structure with said inner and outer annulus walls for effecting an increased rigidity of the combustor.

10. The combustor according to claim 1, wherein said section walls divide said combustion zone into a plurality of substantially equal segments.

11. An annular combustor for use in a turbine engine comprising a compressor section, a combustion section downstream from the compressor section, a turbine section downstream from the combustion section, and defining an axis of rotation, the annular combustor comprising:

a generally circumferential inner annulus wall extending from a burner end of the annular combustor to an outlet end of the annular combustor adjacent the turbine section of the engine;

a generally circumferential outer annulus wall disposed outwardly from said inner annulus wall and extending from said burner end of the annular combustor to said outlet end of the annular combustor adjacent the turbine section of the engine;

a combustion zone formed between said inner annulus wall and said outer annulus wall, said combustion zone defining an area adjacent to said burner end of the annular combustor where air transported from the compressor section of the engine is mixed with a fuel and ignited;

a passageway formed between said inner annulus wall and said outer annulus wall extending from said combustion zone to said outlet end of the combustor for conveying an ignited air and fuel mixture from said combustion zone to said outlet end of the combustor;

a plurality of burners associated with said burner end of the annular combustor for distributing the fuel to said combustion zone; and a plurality of section walls symmetrically distributed about the axis of rotation of the turbine engine, the section walls extending radially from said inner annulus wall to said outer annulus wall and extending in continuous contact with said inner and outer annulus walls from said burner end of the annular combustor to said outlet end of the annular combustor, said section walls dividing said combustion zone into a plurality of segments, each segment containing at least one of said burners.

12. The annular combustor according to claim 11, wherein said section walls comprise a tapered end portion.

13. The annular combustor according to claim 11, wherein each of said section walls comprises at least one hollow portion that acts as a resonator for reducing vibrations of the combustor.

14. The annular combustor according to claim 13, wherein each of said section walls includes a plurality of apertures formed in a surface thereof in communication with said hollow portion, said apertures permitting a flow of a fluid therethough between a location outside of said section walls and said hollow portion.

15. The annular combustor according to claim 13, wherein first and second side walls of each of said section walls include a plurality of apertures formed in outer surfaces thereof in communication with said hollow portion, said apertures permitting a flow of a fluid therethough between a location outside of said section wall and said hollow portion.

16. The annular combustor according to claim 11, wherein said section walls each create an I-beam structure with said inner and outer annulus walls for effecting an increased rigidity of the combustor.

17. The annular combustor according to claim 11, wherein said section walls divide said combustion zone into a plurality of substantially equal segments, each segment containing a plurality of said burners.

18. The combustor according to claim 8, wherein each said segment comprises a common area into which the respective plurality of said burners distribute their fuel.

19. The annular combustor according to claim 11, wherein said combustion zone is defined by said inner annulus wall and said outer annulus wall and extends continuously from said inner annulus wall to said outer annulus wall.

20. The annular combustor according to claim 17, wherein each said segment comprises a common area into which the respective plurality of said burners distribute their fuel.

* * * * *

UNITED STATES PATENT AND TRADEMARK OFFICE

CERTIFICATE OF CORRECTION

PATENT NO. : 7,874,138 B2
APPLICATION NO. : 12/208513
DATED : January 25, 2011
INVENTOR(S) : Mark F. Rubio and David M. Ritland It is certified that error appears in the above-identified patent and that said Letters Patent is hereby corrected as shown below:

On the Title Page, Item (75)

Please correct first inventor from Mark B. Rubio to read:

Mark F. Rubio

Signed and Sealed this
First Day of March, 2011

David J. Kappos

David J. Kappos
*Director of the United States Patent and Trademark Office*